US012410794B2

(12) United States Patent
Dong et al.

(10) Patent No.: US 12,410,794 B2
(45) Date of Patent: Sep. 9, 2025

(54) COMPRESSOR AND AIR CONDITIONER

(71) Applicant: GREE ELECTRIC APPLIANCES, INC. OF ZHUHAI, Zhuhai (CN)

(72) Inventors: Mingzhu Dong, Zhuhai (CN); Yusheng Hu, Zhuhai (CN); Yuanpei Hu, Zhuhai (CN); Huijun Wei, Zhuhai (CN); Ouxiang Yang, Zhuhai (CN); Xinai Zhang, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 18/814,186

(22) Filed: Aug. 23, 2024

(65) Prior Publication Data

US 2024/0418170 A1 Dec. 19, 2024

Related U.S. Application Data

(63) Continuation of application No. PCT/CN2022/140632, filed on Dec. 21, 2022.

(30) Foreign Application Priority Data

May 30, 2022 (CN) ..... 202210603409.7

(51) Int. Cl.
*F04C 18/356* (2006.01)
*F04C 23/00* (2006.01)
*F04C 29/00* (2006.01)

(52) U.S. Cl.
CPC ..... *F04C 18/3564* (2013.01); *F04C 18/356* (2013.01); *F04C 23/001* (2013.01);
(Continued)

(58) Field of Classification Search
CPC .. F04C 18/356; F04C 18/3564; F04C 23/001; F04C 23/008; F04C 29/00;
(Continued)

(56) References Cited

FOREIGN PATENT DOCUMENTS

CN 1601126 A 3/2005
CN 104879287 A 9/2015
(Continued)

OTHER PUBLICATIONS

CN208831239U—SI—Rotary Compressor—May 7, 2019—Rotary Compressor—English Machine Translation. (Year: 2019).*
(Continued)

*Primary Examiner* — Theresa Trieu
(74) *Attorney, Agent, or Firm* — Christensen O'Connor Johnson Kindness PLLC

(57) ABSTRACT

A compressor and an air conditioner. The compressor includes a crankshaft, a first roller, a second roller, a motor rotor and one balancing block. The interior of the first roller is a solid structure, and the interior of the second roller has a hollow portion. The balancing block is disposed at one axial end of the motor rotor, and no balancing block is arranged at another axial end of the motor rotor. A mass center of the first eccentric portion and the first roller is a first mass center, and a first mass-center axis passes through the first mass center and is parallel to an axis of the crankshaft. A mass center of the second eccentric portion and the second roller is a second mass center, and a second mass-center axis passes through the second mass center and is parallel to the axis of the crankshaft.

20 Claims, 11 Drawing Sheets

(52) U.S. Cl.
CPC ..... *F04C 29/0021* (2013.01); *F04C 29/0057* (2013.01); *F04C 2240/20* (2013.01); *F04C 2240/601* (2013.01); *F04C 2240/807* (2013.01); *F04C 2250/301* (2013.01)

(58) Field of Classification Search
CPC .. F04C 29/0021; F04C 29/0057; F04C 29/06; F04C 2250/301; F04C 2240/20; F04C 2240/50; F04C 2240/807
See application file for complete search history.

(56) References Cited

FOREIGN PATENT DOCUMENTS

| | | | |
|---|---|---|---|
| CN | 104963868 | A | 10/2015 |
| CN | 205136001 | U | 4/2016 |
| CN | 105221424 | B | 12/2017 |
| CN | 109139477 | A | 1/2019 |
| CN | 208831239 | U | 5/2019 |
| CN | 110425108 | A | 11/2019 |
| CN | 110873051 | A | 3/2020 |
| CN | 210422936 | U | 4/2020 |
| CN | 114215753 | A | 3/2022 |
| CN | 114857005 | A | 8/2022 |
| CN | 217481535 | U | 9/2022 |
| JP | S623193 | A | 1/1987 |
| JP | 2020186660 | A | 11/2020 |
| KR | 20110120105 | A | 11/2011 |

OTHER PUBLICATIONS

CN210422936U—Shen et al.—Crankshaft Assembly, Compressor and Air Conditioner—Apr. 28, 2020—English Machine Translation. (Year: 2020).*

International Search Report and Written Opinion mailed Mar. 19, 2023, issued in corresponding International Application No. PCT/CN2022/140632, filed Dec. 21, 2022, 16 pages.

Office Action mailed Mar. 5, 2025, in corresponding Chinese application No. 202210603409.7, filed May 30, 2022, 16 pages.

* cited by examiner

COMPRESSOR AND AIR CONDITIONER

CROSS-REFERENCE TO RELATED APPLICATION

The present disclosure is a continuation application of PCT Patent Application No. PCT/CN2022/140632, filed on Dec. 21, 2022, which claims the priority of Chinese patent application No. 202210603409.7, filed on May 30, 2022, which are incorporated herein by reference in their entireties.

TECHNICAL FIELD

The present disclosure relates to the technical field of compressors, and in particular to a compressor and an air conditioner.

BACKGROUND

During a design process of a compressor, noise and vibration are required to be strictly controlled. Especially for a compressor used in a household air conditioner, the requirements for the noise and vibration are stricter. How to reduce the vibration level of compressors has always been a research topic for compressor developers. In a rotor compressor often used the household air conditioner, an eccentric portion is arranged on a crankshaft and located at a position of the cylinder. The roller is driven by the eccentric structure, thus realizing suction, compression and exhaust process inside the compressor. Since the crankshaft is provided with the eccentric portion, balancing blocks are usually arranged at the upper and lower ends of the motor respectively, to ensure the force balance and the torque balance of the whole shaft system, thus reducing vibration. However, the top of the crankshaft has a relatively large deflection deformation due to the relatively large masses of the main and auxiliary balancing blocks, which, combining with the high-speed operation of the motor rotor, causes the compressor to have a relatively large vibration. With the development of a compressor towards high-speed and miniaturized one, the problem of vibration of the compressor has become more and more serious, and it is urgent to develop a new balancing system to reduce the vibration of the compressor significantly.

SUMMARY

To solve the above problems, the present disclosure provides a compressor, which includes:

- a crankshaft, where the crankshaft includes a first eccentric portion and a second eccentric portion, and the first eccentric portion and the second eccentric portion are located on different shaft sections of the crankshaft respectively;
- a first roller sleeved on an outer circumference of the first eccentric portion, the interior of the first roller being a solid structure;
- a second roller sleeved on an outer circumference of the second eccentric portion, the interior of the second roller having a hollow portion to form a cavity;
- a motor rotor sleeved on the crankshaft; and
- one balancing block disposed at an axial end of the motor rotor.

A mass center of the first eccentric portion and the first roller is a first mass center, and an first mass-center axis passes through the first mass center and is parallel to an axis of the crankshaft; a mass center of the second eccentric portion and the second roller is a second mass center, and a second mass-center axis passes through the second mass center and is parallel to the axis of the crankshaft; and a mass center of the balancing block, the first mass-center axis and the second mass-center axis are located in the same plane.

In the plane, the first mass center is located on a first side of the axis of the crankshaft, and the mass center of the balancing block is located on a second side of the axis of the crankshaft, and the axis of the crankshaft is located between the mass center of the balancing block and the first mass center; and the second mass center is located on the second side of the axis of the crankshaft.

In some embodiments, the first roller is located between the motor rotor and the second roller along an axis direction of the crankshaft.

In some embodiments, the balancing block is disposed on the motor rotor and is located at one axial end of the motor rotor away from the first roller along an axis direction of the crankshaft; or the balancing block is arranged on the motor rotor and is located at another axial end of the motor rotor proximate to the first roller along the axis direction of the crankshaft.

In some embodiments, one hollow portion is formed, and the hollow portion is an annular cavity; the second roller is divided by the annular cavity into a radial inner wall, a radial outer wall, a first axial end and a second axial end; a radial thickness of the radial inner wall is b; a radial thickness of the radial outer wall is a; an axial thickness of the first axial end is c; an axial thickness of the second axial end is d; a total radial thickness of the second roller is t; a total axial thickness of the second roller is h; and it is satisfied that:

$$a \geq \frac{1}{4}t,\ b \geq \frac{1}{4}t,\ c \geq \frac{1}{8}h, \text{ and } d \geq \frac{1}{8}h.$$

In some embodiments, two hollow portions are provided, and the two hollow portions are spaced apart along an axial direction of the second roller; a supporting portion is disposed between the two hollow portions; radial thicknesses of radial inner walls of the two hollow portions each are b1, and radial thicknesses of radial outer walls of the two hollow portions each are a1; an axial thickness of a third axial end of one hollow portion away from the other hollow portion is c1, and an axial thickness of a fourth axial end of the other hollow portion away from the one hollow portion is d1; a total radial thickness of the second roller is t, and a total axial thickness of the second roller is h, and it is satisfied that:

$$a1 \geq \frac{1}{6}t,\ b1 \geq \frac{1}{6}t,\ c1 \geq \frac{1}{12}h, \text{ and } d1 \geq \frac{1}{12}h.$$

In some embodiments, an axial thickness of the supporting portion is e1, and $$e1 \geq \frac{1}{24}h.$$

In some embodiments, the number of the hollow portions is n, and the n hollow portions are spaced and arranged sequentially along an axial direction of the second roller, where n≥1; a total radial thickness of the second roller is t, and a total axial thickness of the second roller is h.

Radial thicknesses of radial outer walls of the n hollow portions each are a, and radial thicknesses of radial inner walls of the n hollow portions each are b, and it is satisfied that $a \geq t/(2(n+1))$, and $b \geq t/(2(n+1))$.

Among the n hollow portions, an axial thickness of one axial end of each hollow portion is c, and an axial thickness of the other axial end of each hollow portion is d, and it is satisfied that $c \geq h/(4(n+1))$, and $d \geq h/(4(n+1))$.

A supporting portion is arranged between any two adjacent hollow portions among the n hollow portions, and axial thicknesses e of multiple supporting portions are equal, and $e \geq h/(8(n+1))$.

In some embodiments, the compressor is a vertical compressor, the first roller and the second roller are arranged vertically; the first roller is located above the second roller; the motor rotor is located above the first roller; and the balancing block is arranged on an upper end surface of the motor rotor or on a lower end surface of the motor rotor.

In some embodiments, a mass of the first roller and the first eccentric portion is m1; the minimum distance between the first mass center and the axis of the crankshaft is r1; a mass of the second roller and the second eccentric portion is m0; the minimum distance between the second mass center and the axis of the crankshaft is r0; a mass of the balancing block is m2; the minimum distance between the mass center of the balancing block and the axis of the crankshaft is r2; and it is satisfied that:

$$0.8 \leq \frac{m_0 r_0 + m_2 r_2}{m_1 r_1} \leq 1.$$

In some embodiments, a mass of the first roller and the first eccentric portion is m1; the minimum distance between the first mass center and the axis of the crankshaft is r1; a mass of the second roller and the second eccentric portion is m0; the minimum distance between the second mass center and the axis of the crankshaft is r0; a mass of the balancing block is m2; the minimum distance between the mass center of the balancing block and the axis of the crankshaft is r2; along an axis direction of the crankshaft, a distance between the first mass center and the second mass center is l1, and a distance between the mass center of the balancing block and the second mass center is l2, and it is satisfied that:

$$0.6 \leq \frac{m_2 r_2 l_2}{m_1 r_1 l_1} \leq 0.9.$$

The present disclosure further provides an air conditioner, including the compressor of any of the embodiments above.

Figure 1:
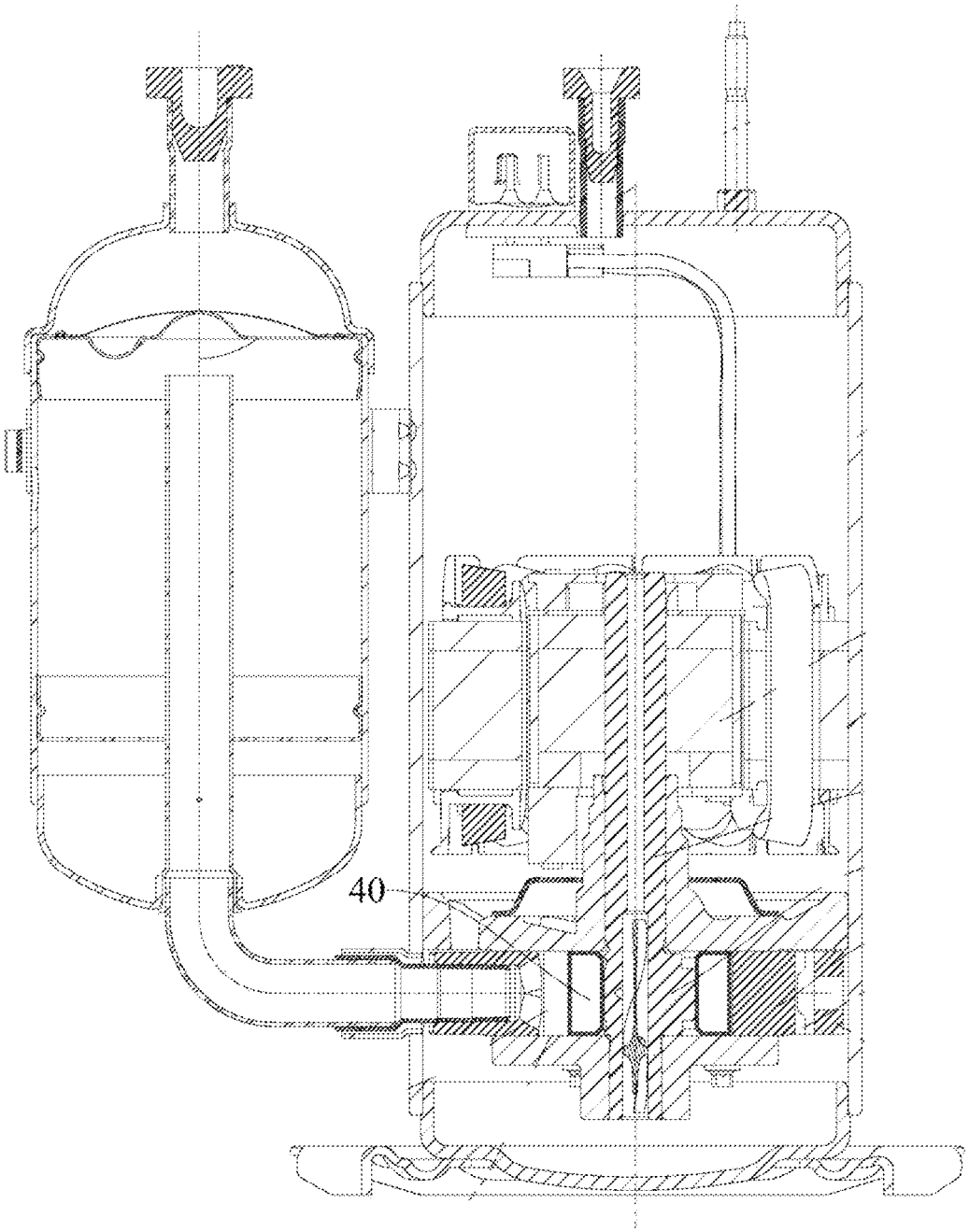
(Prior Art) FIG. 1
FIG. 1 is a view showing a structure of a first compressor in the related art.

The reference numerals are:

1. balancing block; 2. crankshaft; 3. motor rotor; 4. rivet; 5. upper flange; 6. first roller; 7. upper cylinder; 8. partition plate; 9. second roller; 10. lower cylinder; 11. lower flange; 20. first eccentric portion; 21. second eccentric portion; 22. main shaft body; 90. hollow portion; 100. compressor.

90A. radial inner wall; 90B. radial outer wall; 90C. first axial end; 90D. second axial end; 90E. third axial end; 90F. fourth axial end;

91. inner wall surface; 92. upper end surface; 93. first chamfer; 94. second chamfer; 95. supporting portion.

DETAILED DESCRIPTION OF THE EMBODIMENTS

To make the purposes, technical solutions and advantages of the embodiments of the present disclosure clearer, the technical solutions of the present disclosure will be described clearly and completely hereinafter with reference to the drawings of the embodiments. Obviously, the described embodiments are part of the embodiments of the present disclosure, rather than all embodiments. Based on the embodiments in the disclosure, all other embodiments obtained by those of ordinary skill in the art without involving creative work fall within the scope of protection of the present disclosure.

Patent No. CN 201510737107.9 discloses a rotary compressor and a heat pump system having the same, as shown in FIG. 1, a hollow roller 40 is used to reduce the mass of the eccentric component, thereby reducing a counterweight of the main balancing block. However, this technology is only used for single-cylinder compressors, and cannot completely cancel the main balancing block to significantly reduce the crankshaft deflection.

Figure 2:
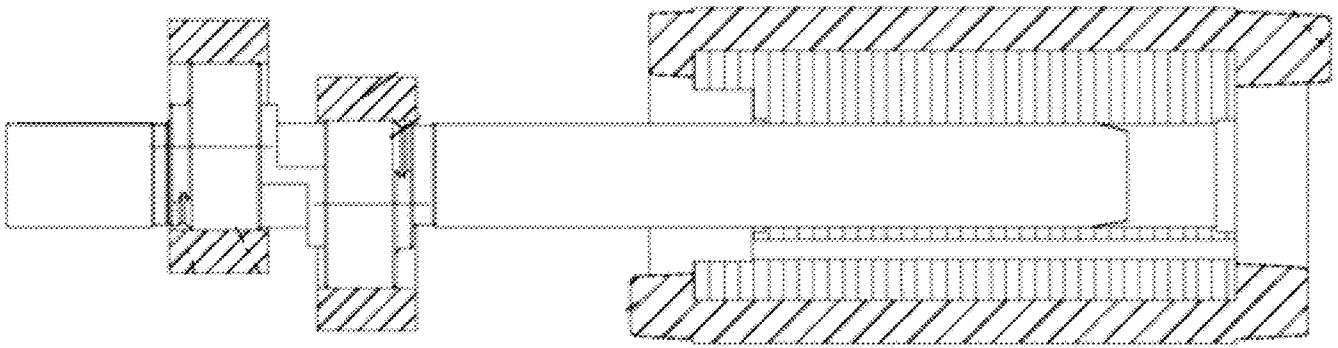
(Prior Art) FIG. 2
FIG. 2 is a view showing a structure of a second compressor in the related art.

Patent number CN 201910798100.6 discloses a crankshaft assembly, a compressor and an air conditioner, as shown in FIG. 2. This technology makes the upper eccentric mass and the upper roller mass greater than the lower eccentric mass and the lower roller mass of the double-cylinder compressor structure respectively, thereby reducing the number of balancing blocks and significantly reducing the crankshaft deflection and the vibration level of the compressor. However, the upper and lower cylinders having different structures will cause a significant loss in the performance of the compressor, cause the processing to be more complicated, and make the cost higher.

Figure 3:
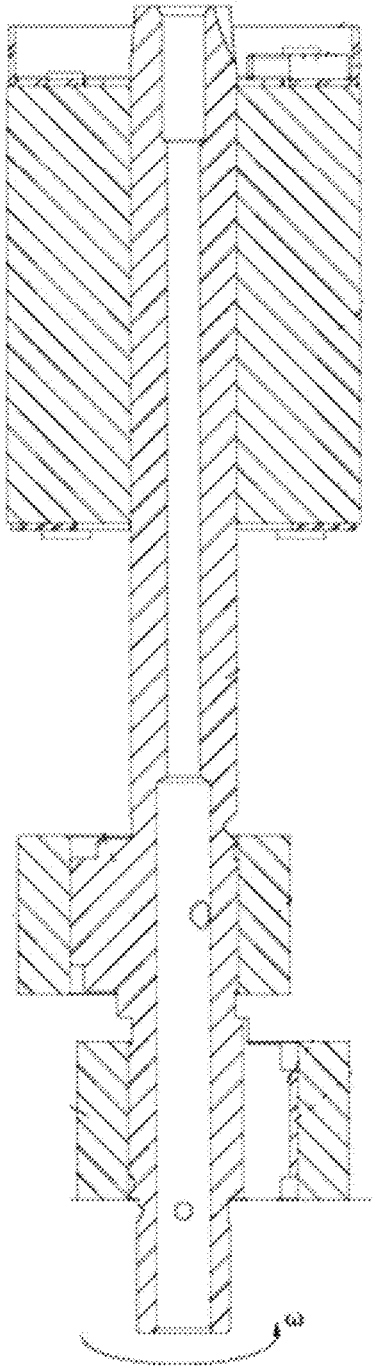
(Prior Art) FIG. 3
FIG. 3 is a view showing a structure of a third compressor in the related art.

Patent No. CN 201811012300.6 discloses a double-cylinder rotary compressor and a crankshaft thereof, as shown in FIG. 3. This technology makes the upper eccentric mass and the upper eccentricity greater than the lower eccentric mass and the lower eccentricity of the double-cylinder compressor structure respectively, thereby reducing the number of the balancing blocks and significantly reducing the crankshaft deflection and the vibration level of the compressor. However, the decrease in the mass of the eccentric part is very limited, and it is not easy to design a single balancing block based on the force balance the torque balance.

Figure 4:
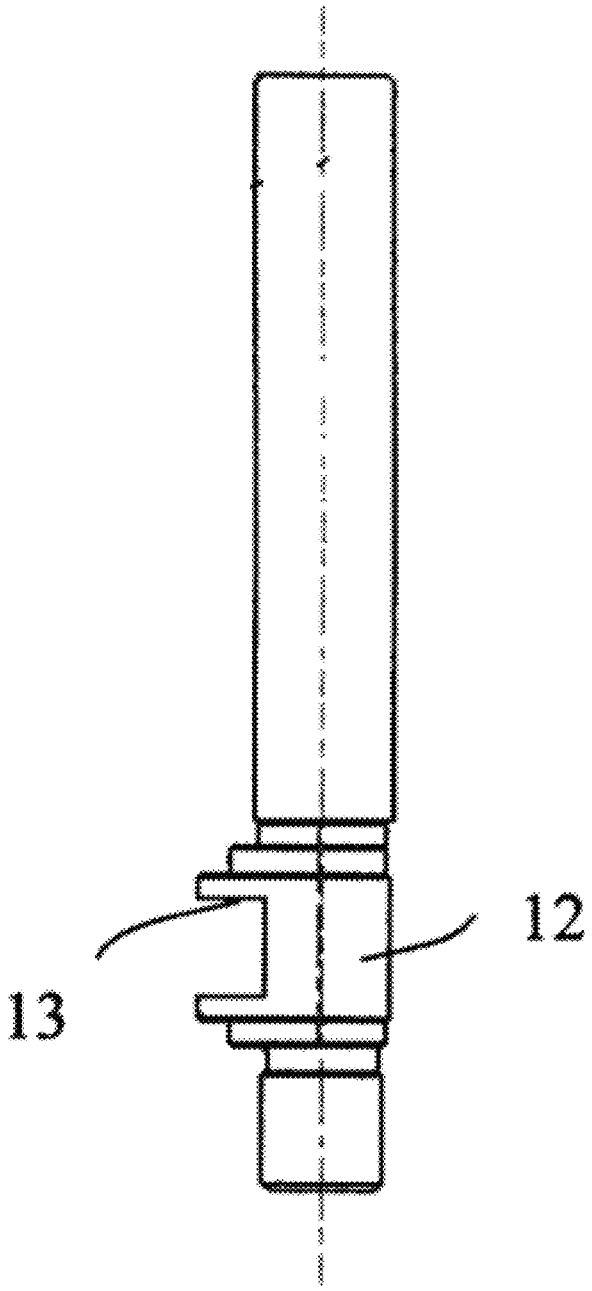
(Prior Art) FIG. 4
FIG. 4 is a view showing a structure of a fourth compressor in the related art.

Patent No. CN03144393.1 discloses a crankshaft of a rotary compressor, as shown in FIG. 4. In this technology, the eccentric portion 12 of the crankshaft is configured to have a crescent-shaped or arch-shaped groove 13, and the eccentric portion 12 is separated and rotatable relative to the crankshaft, so that the gravity center of the eccentric portion coincides with the gravity center of the crankshaft, thereby canceling a balancing block. However, in this technology, the vibration caused by the eccentricity of the roller and the effect of the gas force caused by a gas compression are not taken into consideration, and obviously, if the balancing block is not arranged, a relatively large vibration will be generated.

Since the compressor in the related art has technical problems that the vibration and noise level deteriorate at high frequencies and become more serious for a high-speed compressor, a compressor and an air conditioner in the present disclosure are researched and designed.

To solve the technical problems of the defects of the compressor in the prior art that the effect of vibration reduction is poor especially at high frequencies, the present disclosure provides the compressor and the air conditioner.

The compressor and the air conditioner provided by the present disclosure have the beneficial effects as follows.

In the present invention, one of the rollers in a double-cylinder or multi-cylinder compressor is a hollow structure, thereby allowing the total mass of the second roller and the second eccentric portion to be reduced, and making the second mass center move close to the axis of the crankshaft towards the crankshaft or to be located on the axis of the crankshaft. Under the action of the first roller and the first eccentric portion and the balancing block, the second roller, the second eccentric portion, the first roller, the first eccentric portion and the balancing block may achieve a force balance and a torque balance, thereby effectively cancelling the balancing block that is usually required to be arranged at the other axial end of the motor rotor. Since the number and mass of the balancing blocks are reduced, the crankshaft deflection is greatly reduced, and the vibration and noise levels of the compressor are reduced. Since the weight of the roller is reduced, the centrifugal forces of the second eccentric portion and of the second roller are reduced, thereby reducing the contact stress corresponding to a contact position between the crankshaft and the flange, and effectively improving the reliability of the compressor. Since the roller is lightened, the power consumptions caused by frictions of the roller against the flange, the intermediate partition plate, and the cylinder respectively, etc., may be reduced, thereby further effectively reducing the power consumption of driving the motor, and improving energy efficiency. In the present invention, the number and the weight of the balancing blocks are reduced, and the weight of the lower roller is also reduced, thereby solving the problem of the relatively large weights of the double balancing blocks and of the solid roller of the balancing system in an existing compressor, thereby effectively reducing the weight of the whole machine and saving costs.

As shown in FIGS. 5-11, an embodiment of the present disclosure provides a compressor (for example, a double-cylinder rolling rotor compressor), which includes: a crankshaft 2, a first roller 6, a second roller 9, a motor rotor 3, and a balancing block 1. The crankshaft 2 includes a first eccentric portion 20 and a second eccentric portion 21. The first eccentric portion 20 and the second eccentric portion 21 are located on different shaft sections of the crankshaft 2 respectively. The first roller 6 is sleeved on the outer circumference of the first eccentric portion 20, and the second roller 9 is sleeved on the outer circumference of the second eccentric portion 21.

The interior of the first roller 6 is a solid structure, and the interior of the second roller 9 has a hollow portion 90 to form a cavity. The motor rotor 3 is sleeved on the crankshaft 2. Specifically, the crankshaft 2 includes a main shaft body 22, and the motor rotor 3 is sleeved on a first end of the main shaft body 22, and the first eccentric portion 20 and the second eccentric portion 21 are disposed at a second end of the main shaft body 22. The balancing block 1 is arranged on an axial end of the motor rotor 3, and no balancing block is arranged on the other axial end of the motor rotor 3.

The mass center of the first eccentric portion 20 and the first roller 6 is a first mass center, the first mass-center axis passes through the first mass center and is parallel to the axis of the crankshaft 2. The mass center of the second eccentric portion 21 and the second roller 9 is a second mass center, the second mass-center axial passes through the second mass center and is parallel to the axis of the crankshaft 2. The mass center of the balancing block 1, the first mass-center axis and the second mass-center axis are in the same plane, and the plane passes through the axis of the crankshaft 2.

And in the plane, the first mass center is located on a first side of the axis of the crankshaft 2, the mass center of the balancing block 1 is located on a second side of the axis of the crankshaft 2, so that the axis of the crankshaft is located between the mass center of the balancing block 1 and the first mass center, and that the second mass center is located on the second side of the axis of the crankshaft 2.

In the present invention, one of the rollers in the double-cylinder or the multi-cylinder compressor has the hollow structure, thereby allowing the total mass of the second roller 9 and the second eccentric portion 21 to be reduced, and making the second mass center move close to the axis of the crankshaft 2 towards the crankshaft or to be located on the axis of the crankshaft 2. Under the action of the first roller 6 and the first eccentric portion 20 and the balancing block 1, the second roller 9, the second eccentric portion 21, the first roller 6, the first eccentric portion 20 and the balancing block 1 may achieve a force balance and a torque balance, thereby effectively cancelling the balancing block 1 that is usually required to be arranged at the other axial end of the motor rotor 3. Since the number and mass of the balancing blocks 1 are reduced, the crankshaft deflection is greatly reduced, and the vibration and noise levels of the compressor are reduced. Since the weight of the roller is reduced, the centrifugal forces of the second eccentric portion 21 and of the second roller 9 are reduced, thereby reducing the contact stress corresponding to the contact position between the crankshaft 2 and the flange, and effectively improving the reliability of the compressor. Since the roller is lightened, the power consumptions caused by the frictions of the roller against the flange, the intermediate partition plate, and the cylinder respectively, etc., may be reduced, thereby further effectively reducing the power consumption of driving the motor, and improving energy efficiency. In the present invention, the number and the weight of the balancing blocks 1 are reduced, and the weight of the second roller 9 is also reduced, thereby solving the problem of the large weights of the double balancing blocks and of the solid roller of the balancing system in the existing compressor, thereby effectively reducing the weight of the whole machine and saving the costs.

Figure 5:
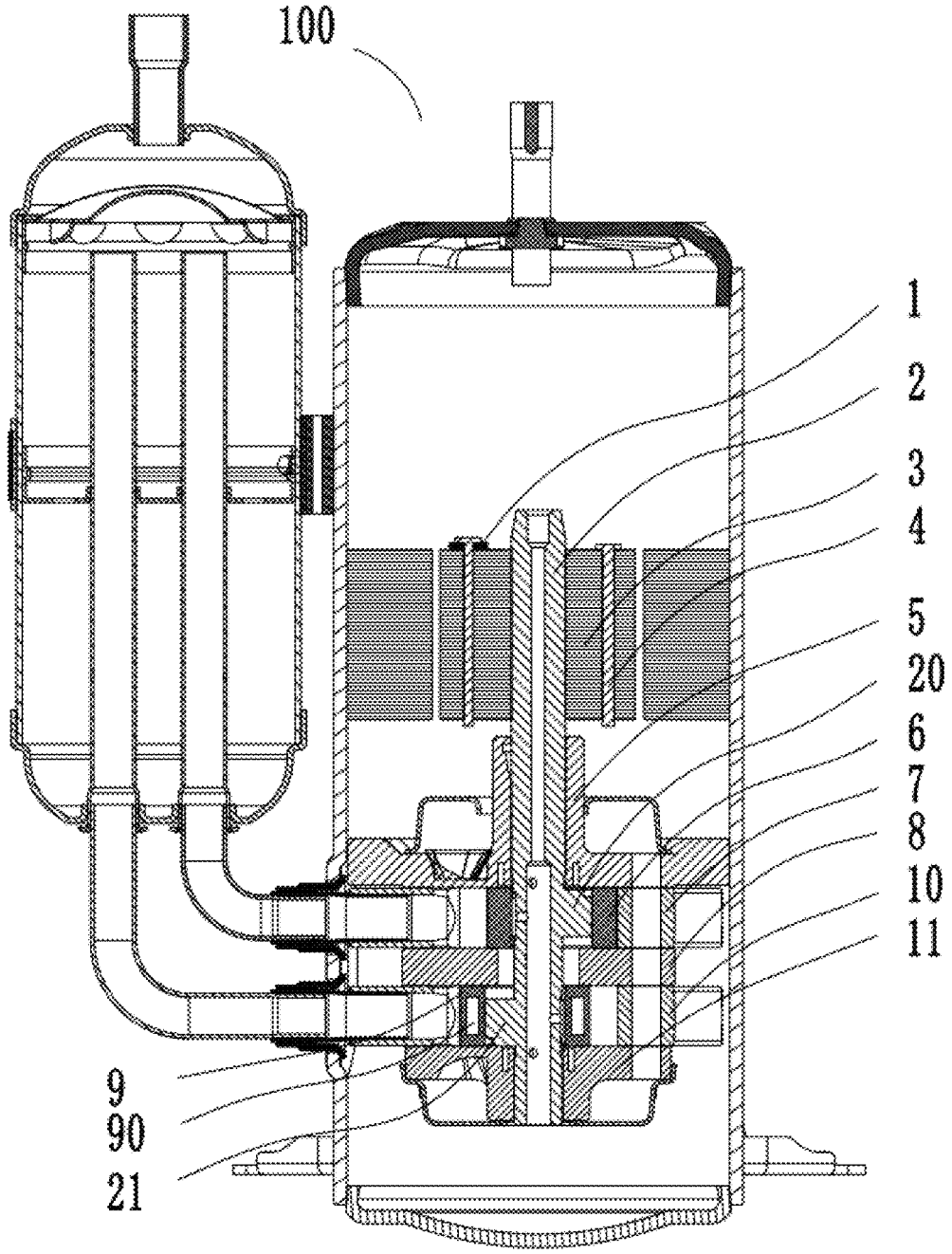
FIG. 5 is a sectional view of a whole compressor having a balancing system with low vibration according to some embodiments of the present disclosure.

As shown in FIG. 5, according to an embodiment of the present application, a balancing system, applied to a double-cylinder rolling rotor compressor 100, includes: a balancing block 1, a crankshaft 2, a first roller 6 (an upper roller), and a second roller 9 (a lower roller). The crankshaft 2 is provided with a first eccentric portion 20 (an upper eccentric portion) and a second eccentric portion 21 (a lower eccentric portion), and the first roller 6 is sleeved on the first eccentric portion 20 of the crankshaft 2 and located in the inner cavity of the upper cylinder 7. The upper end surfaces of the upper cylinder 7 and of the first roller 6 are in contact with the lower end surface of the upper flange 5, and the lower end surfaces of the upper cylinder 7 and of the first roller 6 are in contact with the upper end surface of the partition plate 8. The second roller 9 is sleeved on the second eccentric portion 21 of the crankshaft 2 and located in the inner cavity of the lower cylinder 10. The upper end surfaces of the lower cylinder 10 and of the second roller 9 are in contact with the lower end surface of the partition plate 8, and the lower end surfaces of the lower cylinder 10 and of the second roller 9 are in contact with the upper end surface of the lower flange 11. The upper flange 5, the upper cylinder 7, the partition plate 8, the lower cylinder 10, and the lower flange 11 are directly locked together by screws. The long shaft section of the crankshaft 2 passes through the inner hole of the upper flange 5, the middle shaft section of the crankshaft 2 passes through the inner hole of the partition plate 8, and the short shaft section of the crankshaft 2 passes through the inner hole of the lower flange 11. The long shaft section of the crankshaft 2 is connected to the inner hole of the motor rotor 3 by interference fit. The rotation of the motor rotor 3 drives the crankshaft 2 to rotate. The first eccentric portion 20 of the crankshaft 2 drives the first roller 6 to rotate in the upper cylinder 7, and the second eccentric portion 21 of the crankshaft 2 drives the second roller 9 to rotate in the lower cylinder 10. A balancing block 1 is arranged on the upper end of motor rotor 3 and is attached to the motor rotor 3 with a rivet 4 to maintain the balance of the entire balancing system.

To ensure the performance of the compressor 100, the upper cylinder 7 and the lower cylinder 10 are designed to have the same inner diameter and have the same cylinder height. The first roller 6 and the second roller 9 are designed to have the same inner diameter, the same outer diameter, and the same height respectively. The first eccentric portion 20 and the second eccentric portion 21 of the crankshaft 2 have the same structure and are arranged on two sides of the crankshaft 2 respectively with a location difference of 180°. The upper and lower cavities have the same overall structure and the same size, and the rollers are arranged with a phase difference of 180°, so that the crankshaft 2 may bear balanced forces, thereby improving the performance of the compressor. The balancing block 1 is located at the same side where the lower eccentric portion of the crankshaft 2 is located, and has the mass center located in the plane, in which the mass center axis of the upper eccentric portion and the mass center axis of the lower eccentric portion of the crankshaft 2 are located.

Figure 6:
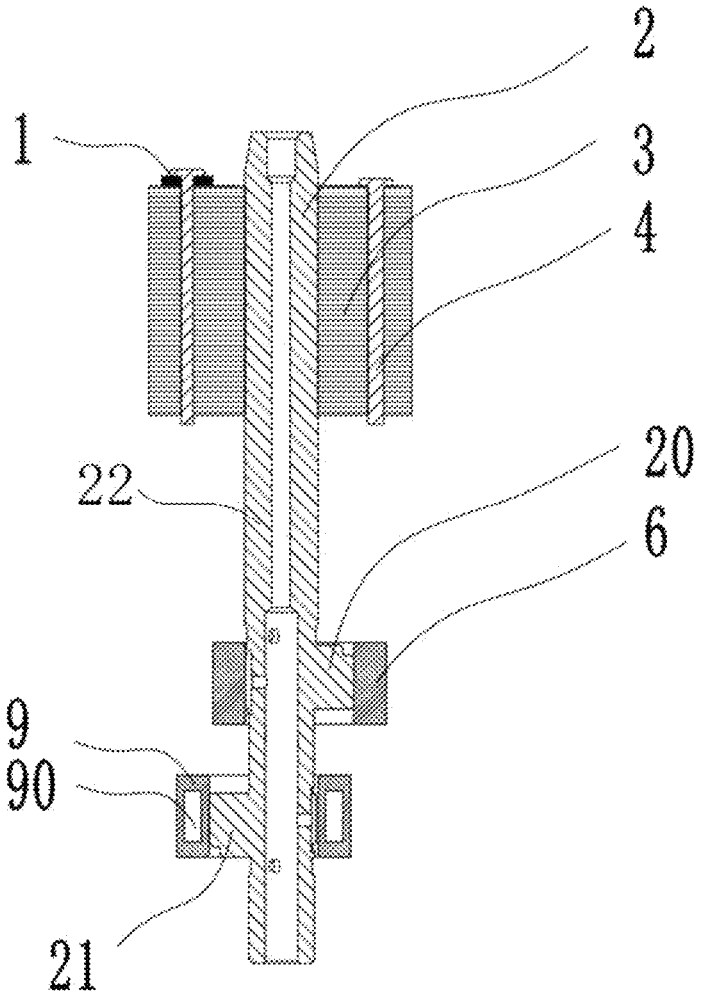
FIG. 6 is a view showing a balancing system with a single balancing block of the present disclosure.

FIG. 6 is a view showing a balancing system having a single balancing block. In the system, the first roller 6 sleeved on the first eccentric portion 20 of the crankshaft 2 has a solid structure, and the second roller 9 sleeved on the second eccentric portion 21 of the crankshaft 2 has a hollow structure. The first roller 6 and the second roller 9 are made of the same material, and the hollow portion 90 of the second roller 9 has the weight reduced compared with the first roller 6. Due to a mass difference between the first roller 6 and the second roller 9, the balancing block 1 is required to be arranged on the motor and on the same side where the second roller 9 is located, so as to ensure the balance of forces received by the compressor. The structure, height, weight, mass center distance, etc. of the balancing block 1 may be adjusted based on the force balance and the torque balance of the entire balancing system. Since the mass of the balancing block 1 is determined by the mass difference between the first roller 6 and the second roller 9, compared with the traditional structure of arranging two balancing blocks including the main and auxiliary balancing blocks, the balancing block 1 of the present disclosure may be designed to have a smaller mass and a smaller height, thereby not only greatly reducing the deflection of the top end of the crankshaft 2 and reducing the vibration of the compressor, but also significantly reducing a power consumption caused by a wind resistance during the rotation of the balancing block 1 and improving the energy efficiency of the compressor.

Figure 9:
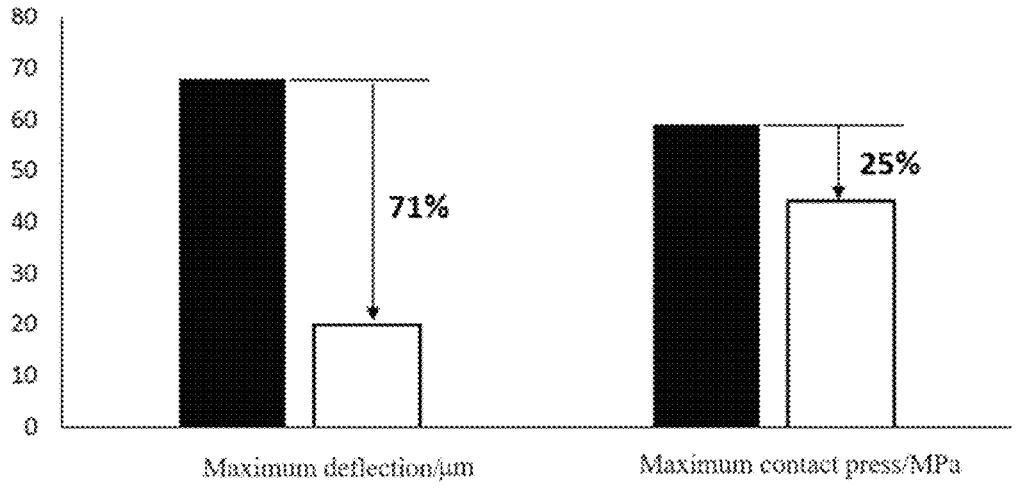
FIG. 9 is a diagram showing technical effects of the present disclosure compared with a conventional solution.

FIG. 9 is a diagram showing technical effects of the present disclosure compared with a solution of a conventional double-cylinder compressor. In the conventional balancing solution, the upper and lower rollers are completely consistent and the main and auxiliary two balancing blocks are used. In FIG. 9, black rectangular blocks represent the conventional solution, and white rectangular blocks represent the solution of the present invention. Compared with the conventional solution, the solution of the present invention may reduce the maximum deflection of the crankshaft by 71%, and reduce the maximum contact stress of the crankshaft by 25%, which not only greatly reduces the vibration level of the compressor, but also reduces the wear between the crankshaft and the flange, thus improving the reliability of the parts.

1. The mass of the lower roller of the present disclosure is less than that of the upper roller, and the lower roller may be a hollow structure, a hollow structure with a supporting portion, or may be made of lightweight material.

2. For the hollow second roller 9, thicknesses of the radial inner wall 90A and radial outer wall 90B of the second roller 9 satisfy the following relationships:

$$a \geq \frac{1}{4}t, \text{ and } b \geq \frac{1}{4}t.$$

A thickness of the first axial end 90C located at the top of the second roller 9 and a thickness of the second axial end 90D located at the bottom of the second roller 9 satisfy the following relationships:

$$c \geq \frac{1}{8}h, \text{ and } d \geq \frac{1}{8}h.$$

3. For the hollow second roller 9 with a supporting portion 95, the following relationships are satisfied:

$$a1 \geq \frac{1}{6}t,\ b1 \geq \frac{1}{6}t,\ c1 \geq \frac{1}{12}h,\ d1 \geq \frac{1}{12}h, \text{ and } e1 \geq \frac{1}{24}h.$$

4. Only one balancing block 1 is arranged on the top or bottom of the motor rotor 3. The balancing block 1 may be located on the top or bottom of the motor rotor 3. The balancing block 1 is located on the same side as the second eccentric portion 21 located on a lower part of the crankshaft 2, and has the mass center located in the plane where the first mass-center axis corresponding to the first eccentric portion 20 and the second mass-center axis corresponding to the second eccentric portion 21 of the crankshaft 2 are located.

5. The respective masses, eccentricities and distances of the first roller 6, of the second roller 9 and of the balancing block 1 satisfy:

$$0.8 \le \frac{m_0 r_0 + m_2 r_2}{m_1 r_1} \le 1 \text{ and } 0.6 \le \frac{m_2 r_2 l_2}{m_1 r_1 l_1} \le 0.9.$$

6. The balancing block 1 is a flat structure and is fixed on the top or bottom of the motor rotor 3 with the rivet.

The present invention solves technical problems as follows.

1. The vibration and noise levels deteriorate at high frequencies and become more serious for a high-speed compressor.

2. The balancing blocks of the balancing system in the related art have relatively large volumes and masses, thus the wind resistance is relatively large, and the power consumption for driving the motor is relatively large.

3. The double balancing blocks and the solid roller of the balancing system of the compressor in the related art have relatively large weights and high costs.

The present disclosure can achieve beneficial effects as follows.

1. The number of the balancing blocks is reduced, the crankshaft deflection is significantly reduced, and the vibration and noise levels of the compressor are decreased.

2. A direct-contact stress between the crankshaft and the flange is decreased (due to the relatively small weight and the reduced centrifugal force, the contact stress corresponding to a contact position between the crankshaft and the flange is decreased), thereby improving the reliability of the compressor.

3. As the roller becomes lighter, the power consumption (caused by the frictions of the roller against the flange, against the intermediate partition plate, and against the cylinder, respectively) is reduced. The power consumption of driving the motor is reduced due to a reduction of the contact stress between the crankshaft and the flange, thereby improving the energy efficiency.

4. The number and the weights of the balancing blocks are reduced, and the weight of the lower roller is reduced, thereby saving costs.

In some embodiments, the first roller 6 is disposed between the motor rotor 3 and the second roller 9. The second roller 9, compared with the first roller 6, is farther from the motor rotor 3, which is a preferred structure of the present disclosure. That is, as shown in FIG. 5, the motor rotor 3, the first roller 6 and the second roller 9 are arranged in sequence from top to bottom, and the mass centers of the first roller 6 and the second roller 9 are located at two sides of the axis of the crankshaft 2 respectively.

In some embodiments, the balancing block 1 is disposed on the motor rotor 3 and is located on one axial end thereof away from the first roller 6 along the axis of the crankshaft 2. Alternatively, the balancing block 1 is disposed on the motor rotor 3 and is located at another axial end thereof proximate to the first roller 6 along the axis of the crankshaft 2. In the main embodiment shown in FIG. 5, the balancing block 1 is disposed at the axial end of the motor rotor 3 away from the first roller 6 along the axis of the crankshaft 2. In a first alternative embodiment shown in FIG. 10, the balancing block 1 is disposed at the other axial end of the motor rotor 3 proximate to the first roller 6 along the axis of the crankshaft 2.

Figure 10:
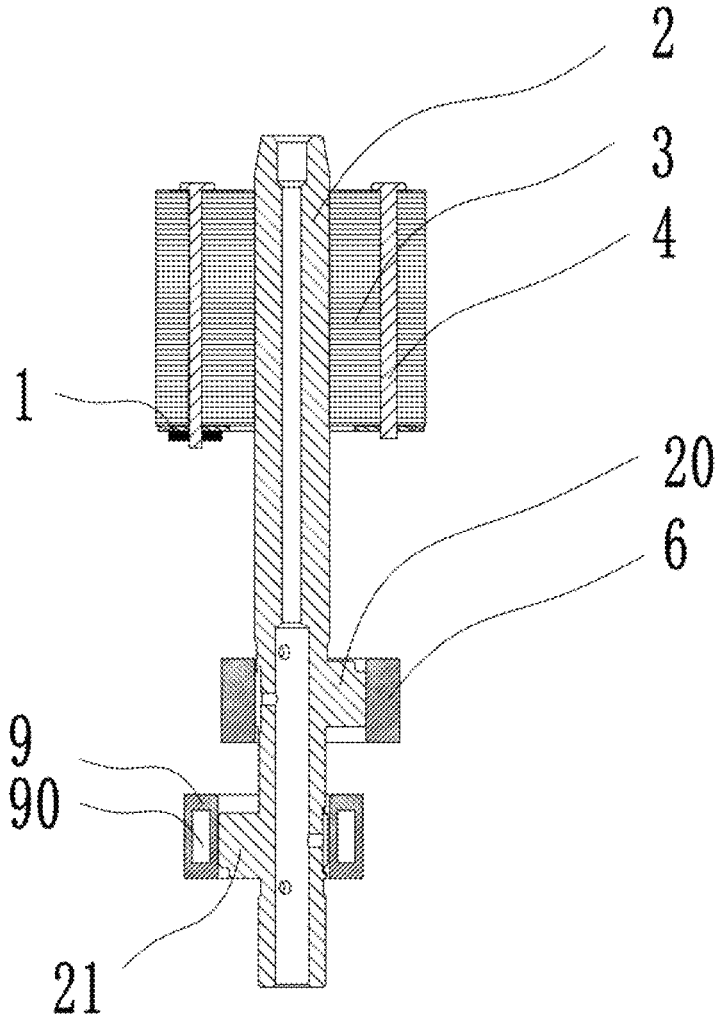
FIG. 10 is a view showing a balancing system with a single main balancing block according to a first alternative embodiment of the present disclosure.

In the first alternative embodiment, as shown in FIG. 10, according to the mass difference between the upper roller (the first roller 6) and the lower roller (the second roller 9), the balancing block 1 may also be arranged at a lower position of the motor rotor 3 and used as the main balancing block. No auxiliary balancing block is provided. This solution may make the deflection of the top of the crankshaft 2 smaller, but the maximum deflection of the crankshaft may be generated at the upper eccentric portion (the first eccentric portion 20). In this case, it is necessary to evaluate the influence of the crankshaft deformation on the operation of the upper roller in the upper cylinder 7. If the deflection of the crankshaft 2 generated at the upper eccentric portion (the first eccentric portion 20) is too large, a problem of jamming or leakage between the roller and the cylinder may occur. However, if the crankshaft deformation generated at this location is still within an acceptable range, this scheme achieves a better vibration level than the single balancing block scheme.

In some embodiments, one hollow portion 90 is formed, and the hollow portion 90 is an annular cavity. The second roller is divided into a radial inner wall 90A, a radial outer wall 90B, a first axial end 90C and a second axial end 90D by the annular cavity. A radial thickness of the radial inner wall 90A is b, and a radial thickness of the radial outer wall 90B is a. An axial thickness of the first axial end 90C is c, and an axial thickness of the second axial end 90D is d. The total radial thickness of the second roller 9 is t, and the total axial thickness of the second roller 9 is h. The following relationships are satisfied:

$$a \ge \frac{1}{4}t,\ b \ge \frac{1}{4}t,\ c \ge \frac{1}{8}h, \text{ and } d \ge \frac{1}{8}h.$$

Figure 7:
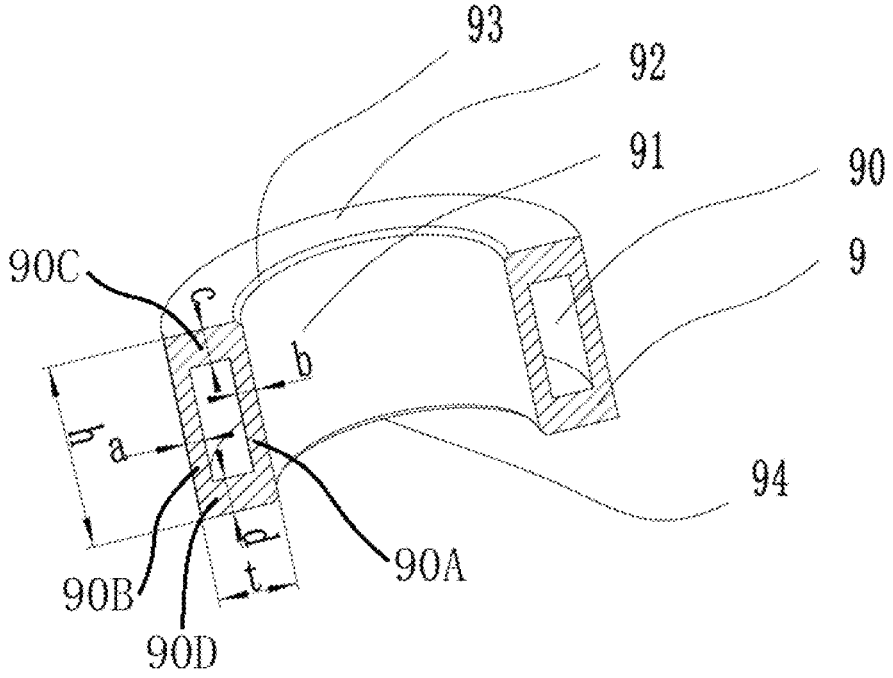
FIG. 7 is a view showing a structure of a second roller according to some embodiments of the present disclosure.

FIG. 7 is a view showing a hollow structure of the second roller 9 of the present disclosure. The second roller 9 is located at a lower position, and the inner wall surface 91 thereof is in contact with the second eccentric portion 21 of the crankshaft 2, and the upper end surface 92 is in contact with the lower end surface of the partition plate 8. A first chamfer 93 and a second chamfer 94 are disposed on top and bottom of the inner wall surface 91, respectively. The arrangement of the hollow portion 90 determines the radial thickness a of the radial outer wall 90B, the radial thickness b of the radial inner wall 90A, the axial thickness c of the first axial end 90C, and the axial thickness d of the second axial end 90D. The second roller 9 is located in the cylinder, and the inner and outer circles of the roller bear a relatively large load when the refrigerant is compressed, therefore the radial thickness a of the radial outer wall 90B, the radial thickness b of the radial inner wall 90A should not be too small, otherwise the inner and outer walls may be caved in towards the center, thus causing a leakage of the refrigerant from the high-pressure chamber to the low-pressure chamber, and causing wear of the roller, of a vane and of other parts. Based on researches, it is obtained that the thicknesses of the inner and outer walls of the second roller 9 meet the following relationships:

$$a \geq \frac{1}{4}t, \text{ and } b \geq \frac{1}{4}t.$$

The upper and lower end surfaces of the second roller 9 also bear relatively high oil film pressures, so the axial thickness c of the first axial end 90C and the axial thickness d of the second axial end 90D should not be too small, otherwise the upper and lower walls may be caved in inwards, thus causing the leakage of refrigerant from the end surface of second roller 9 and the wear of parts of the second roller 9, lower flange 11 and partition plate 8. Based on researches, the axial thicknesses of the first and second axial ends of the second roller 9 meet the following relationships:

$$c \geq \frac{1}{8}h, \text{ and } d \geq \frac{1}{8}h.$$

In some embodiments, two hollow portions 90 are formed, and the two hollow portions 90 are spaced apart along the axial direction of the second roller 9, and a supporting portion 95 is disposed between the two hollow portions 90. The radial thicknesses of the radial inner walls 90A of the two hollow portions 90 are both b1, the radial thicknesses of the radial outer walls 90B of the two hollow portions 90 are both a1. An axial thickness of a third axial end 90E of one hollow portion 90 away from the other hollow portion 90 is c1, and an axial thickness of a fourth axial end 90F of the other hollow portion 90 away from the one hollow portion 90 is d1. The total radial thickness of the second roller 9 is t, and the total axial thickness of the second roller 9 is h. The following relationships are satisfied:

$$a1 \geq \frac{1}{6}t, b1 \geq \frac{1}{6}t, c1 \geq \frac{1}{12}h, \text{ and } d1 \geq \frac{1}{12}h.$$

In some embodiments, an axial thickness of the supporting portion 95 is e1, and $$e1 \geq \frac{1}{24}h.$$

Figure 11:
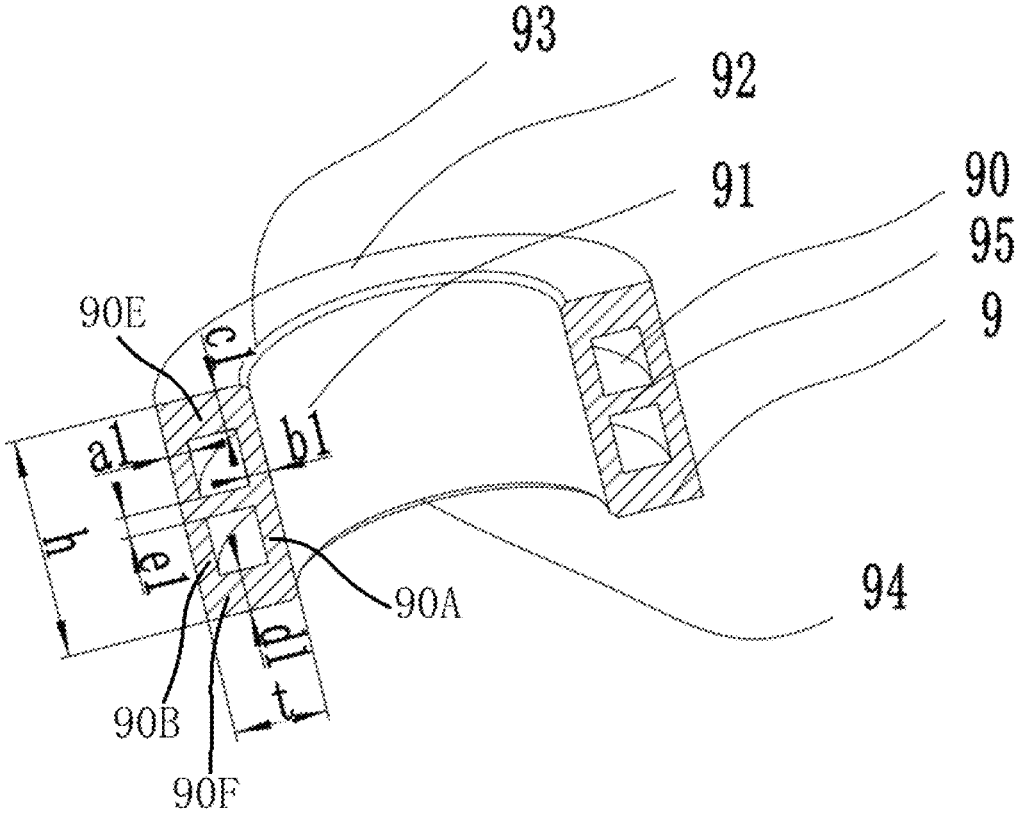
FIG. 11 is a view showing a second roller having an intermediate supporting portion according to a second alternative embodiment of the present disclosure.

In a second alternative embodiment, as shown in FIG. 11, the second roller 9 may also be a hollow structure with the supporting portion 95, which may reduce the deformation of the inner and outer walls of the second roller 9 to a greater extent, and prevent a leakage of refrigerant, and avoid wear of the roller and of other parts. In order to ensure a better supporting effect of the supporting structure, the thickness of the supporting portion 95 should satisfy the following relationship:

$$e1 \geq \frac{1}{24}h.$$

As the supporting structure is arranged, the thicknesses of the upper, lower, left and right walls of the second roller 9 may satisfy the following relationships:

$$a1 \geq \frac{1}{6}t, b1 \geq \frac{1}{6}t, c1 \geq \frac{1}{12}h, \text{ and } d1 \geq \frac{1}{12}h.$$

The original solution of the hollow roller, when configured to have a reasonable structure, will not generate a large deformation. This alternative embodiment may reduce the deformation to a greater extent, but will cause an increase in the processing cost accordingly, so this alternative embodiment is more applicable for a compressor that should meet higher requirements for the hollow roller deformation.

In some embodiments, the number of hollow portions is n, and the n hollow portions 90 are spaced and arranged sequentially along the axial direction of the second roller 9, where n≥1. The total radial thickness of the second roller 9 is t, and the total axial thickness of the second roller 9 is h.

The radial thicknesses of the radial outer walls 90B of the n hollow portions 90 are all a, and the radial thicknesses of the radial inner walls 90A of the n hollow portions 90 are all b, and it is satisfied that a≥t/(2(n+1)), and b≥t/(2(n+1)).

Among the n hollow portions 90, the axial thickness of one axial end of each hollow portion 90 is c, and the axial thickness of the other axial end of each hollow portion 90 is d, and it is satisfied that c≥h/(4(n+1)), and d≥h/(4(n+1)).

A supporting portion 95 is arranged between any two adjacent hollow portions 90 among the n hollow portions 90, and the axial thicknesses e of the plurality of supporting portions 95 are equal, and e≥h/(8(n+1)).

This is a preferred structure of the third embodiment of the present disclosure. This alternative embodiment may reduce the deformation to a greater extent, but will cause an increase in the processing cost accordingly, so this alternative embodiment is more applicable for a compressor that should meet higher requirements for the hollow roller deformation.

In some embodiments, the compressor is a vertical compressor, the first roller 6 and the second roller 9 are arranged vertically, and the first roller 6 is located above the second roller 9. The motor rotor 3 is located above the first roller 6, and the balancing block 1 is arranged on the upper end surface of the motor rotor 3 or on the lower end surface of the motor rotor 3.

In some embodiments, the mass of the first roller 6 and first eccentric portion 20 is $m_1$, the minimum distance between the first mass center and the axis of the crankshaft is $r_1$. The mass of the second roller 9 and second eccentric portion 21 is $m_0$, and the minimum distance between the second mass center and the axis of the crankshaft is $r_0$. The mass of the balancing block 1 is $m_2$, and the minimum distance between the mass center of the balancing block 1 and the axis of the crankshaft is $r_2$. The following relationship is satisfied:

$$0.8 \leq \frac{m_0 r_0 + m_2 r_2}{m_1 r_1} \leq 1.$$

Figure 8:
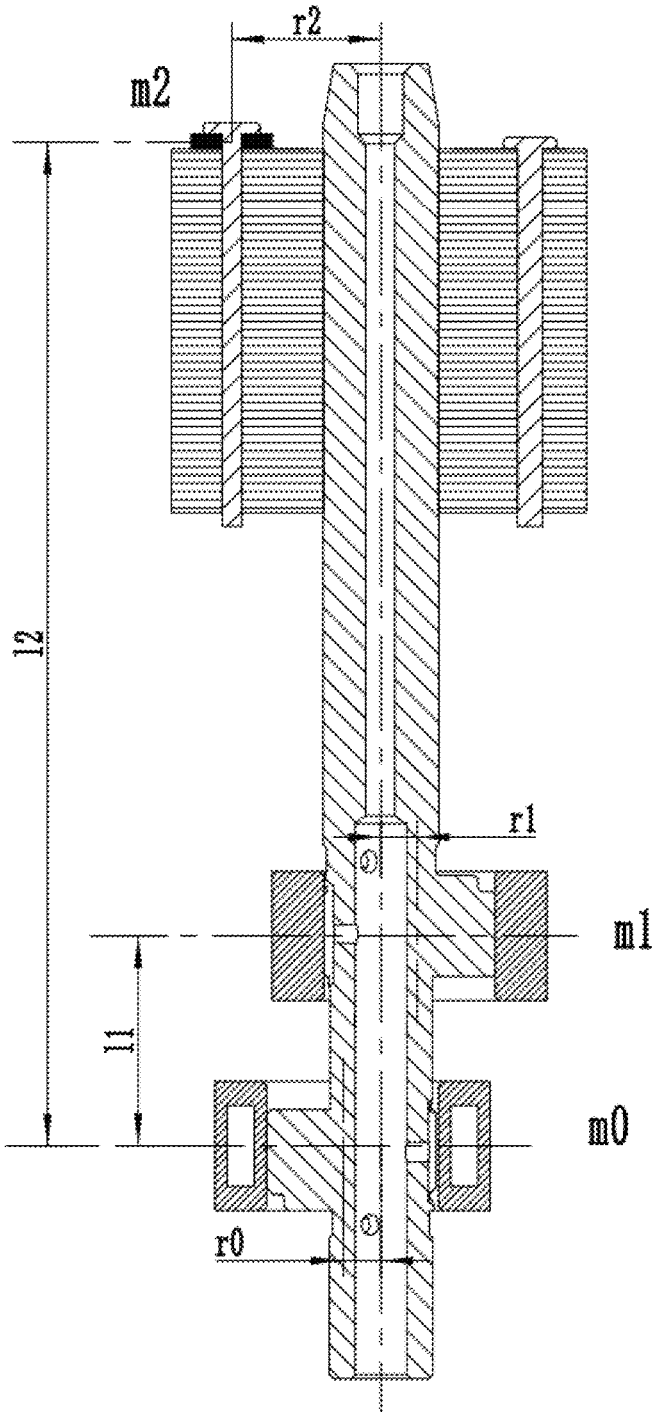
FIG. 8 is a view showing a balancing system of the present disclosure.

FIG. 8 is a view showing dimensions of a balancing system of the present disclosure. The upper eccentricity $r_1$ is equal to the lower eccentricity $r_0$. Due to a difference between the upper and lower eccentricities, the balancing block 1 needs to be arranged on the top of the motor rotor 3. To make the entire balancing system have a relatively small crankshaft deflection, the solution needs to be provided for enabling the force balance and the torque balance to be satisfied. According to researches and experience, the following relationships between the masses of the upper and lower rollers, the mass of the balancing block, the eccentricities, and distances are satisfied:

$$0.8 \le \frac{m_0 r_0 + m_2 r_2}{m_1 r_1} \le 1, \text{ and } 0.6 \le \frac{m_2 r_2 l_2}{m_1 r_1 l_1} \le 0.9.$$

In some embodiments, the mass of the first roller 6 and first eccentric portion 20 is $m_1$, and the minimum distance between the first mass center and the axis of crankshaft is $r_1$. The mass of the second roller 9 and second eccentric portion 21 is $m_0$, and the minimum distance between the second mass center and the axis of the crankshaft is $r_0$. The mass of the balancing block 1 is $m_2$, and the minimum distance between the mass center of the balancing block 1 and the axis of the crankshaft is $r_2$. Along the axis direction of the crankshaft 2, a distance between the first mass center and the second mass center is $l_1$, and a distance between the mass center of balancing block 1 and the second mass center is $l_2$, and the following relationship is satisfied:

$$0.6 \le \frac{m_2 r_2 l_2}{m_1 r_1 l_1} \le 0.9.$$

The present disclosure also provides an air conditioner, which includes any one of the compressors above.

In a third alternative embodiment, the mass difference between the upper and lower rollers may be achieved not only by designing the lower roller to be hollow, but also by using different roller materials. For example, the upper roller is still made of cast iron material such as traditional FC300, and the lower roller may be made of a material with lower density, such as ceramic, aluminum alloy, or titanium alloy etc. The mass difference is achieved by means of a density difference between the upper and lower rollers.

It is easy for those ordinary skill in the art to understand that, under the premise of no conflict, the advantageous technical features of the embodiments above may be freely combined and superimposed.

Described above are only preferred embodiments of the present disclosure and are not intended to limit the present disclosure. Any modifications, equivalent replacements and improvements made within the spirits and principles of the present disclosure would be within the protection scope of the present disclosure. The above are only preferred implementations of the present disclosure. It should be pointed out that, for those ordinary skill in the art, various improvements and variations may be made without departing from the technical principles of the present disclosure, and these improvements and variations should also be regarded as the protection scope of the present disclosure.

What is claimed is:

1. A compressor, comprising:

a crankshaft, wherein the crankshaft comprises a first eccentric portion and a second eccentric portion, and the first eccentric portion and the second eccentric portion are located on different shaft sections of the crankshaft respectively;

a first roller sleeved on an outer circumference of the first eccentric portion, the interior of the first roller being a solid structure;

a second roller sleeved on an outer circumference of the second eccentric portion, the interior of the second roller having a hollow portion to form a cavity;

a motor rotor sleeved on the crankshaft; and one balancing block disposed at an axial end of the motor rotor;

wherein a mass center of the first eccentric portion and the first roller is a first mass center, and an first mass-center axis passes through the first mass center and is parallel to an axis of the crankshaft; a mass center of the second eccentric portion and the second roller is a second mass center, and a second mass-center axis passes through the second mass center and is parallel to the axis of the crankshaft; and a mass center of the balancing block, the first mass-center axis and the second mass-center axis are located in the same plane; and in the plane, the first mass center is located on a first side of the axis of the crankshaft, and the mass center of the balancing block is located on a second side of the axis of the crankshaft, and the axis of the crankshaft is located between the mass center of the balancing block and the first mass center; and the second mass center is located on the second side of the axis of the crankshaft;

wherein one hollow portion is formed, and the hollow portion is an annular cavity; the second roller is divided by the annular cavity into a radial inner wall, a radial outer wall, a first axial end and a second axial end; a radial thickness of the radial inner wall is b; a radial thickness of the radial outer wall is a; an axial thickness of the first axial end is c; an axial thickness of the second axial end is d; a total radial thickness of the second roller is t; a total axial thickness of the second roller is h; and it is satisfied that:

$$a \ge \frac{1}{4}t,\ b \ge \frac{1}{4}t,\ c \ge \frac{1}{8}h, \text{ and } d \ge \frac{1}{8}h.$$

2. The compressor according to claim 1, wherein the first roller is located between the motor rotor and the second roller along an axis direction of the crankshaft.

3. The compressor according to claim 2, wherein the balancing block is disposed on the motor rotor and is located at one axial end of the motor rotor away from the first roller along the axis direction of the crankshaft; or the balancing block is arranged on the motor rotor and is located at another axial end of the motor rotor adjacent to the first roller along the axis direction of the crankshaft.

4. The compressor according to claim 2, wherein the first roller is located in an inner cavity of the upper cylinder, upper end surfaces of the upper cylinder and of the first roller are in contact with a lower end surface of an upper flange, and lower end surfaces of the upper cylinder and of the first roller are in contact with an upper end surface of a partition plate; and the second roller is located in an inner cavity of the lower cylinder, upper end surfaces of the lower cylinder and of the second roller are in contact with a lower end surface of the partition plate, and lower end surfaces of the lower cylinder and of the second roller are in contact with an upper end surface of a lower flange.

5. The compressor according to claim 4, wherein a long shaft section of the crankshaft is configured to pass through an inner hole of the upper flange, a middle shaft section of the crankshaft is configured to pass through an inner hole of the partition plate, and a short shaft section of the crankshaft is configured to pass through an inner hole of the lower flange.

6. The compressor according to claim 4, wherein the upper cylinder and the lower cylinder have the same inner diameter and have the same cylinder height; the first roller and the second roller have the same inner diameter, the same outer diameter, and the same height, respectively; and the first eccentric portion and the second eccentric portion of the crankshaft have the same structure and are arranged on two sides of the crankshaft respectively with a location difference of 180°.

7. The compressor according to claim 1, wherein the compressor is a vertical compressor, the first roller and the second roller are arranged vertically; the first roller is located above the second roller; the motor rotor is located above the first roller; and the balancing block is arranged on an upper end surface of the motor rotor or on a lower end surface of the motor rotor.

8. The compressor according to claim 1, wherein a mass of the first roller and the first eccentric portion is $m_1$; the minimum distance between the first mass center and the axis of the crankshaft is $r_1$; a mass of the second roller and the second eccentric portion is $m_0$; the minimum distance between the second mass center and the axis of the crankshaft is $r_0$; a mass of the balancing block is $m_2$; the minimum distance between the mass center of the balancing block and the axis of the crankshaft is $r_2$; and it is satisfied that:

$$0.8 \le \frac{m_0 r_0 + m_2 r_2}{m_1 r_1} \le 1.$$

9. The compressor according to claim 1, wherein a mass of the first roller and the first eccentric portion is $m_1$; the minimum distance between the first mass center and the axis of the crankshaft is $r_1$; a mass of the second roller and the second eccentric portion is $m_0$; the minimum distance between the second mass center and the axis of the crankshaft is $r_0$; a mass of the balancing block is $m_2$; the minimum distance between the mass center of the balancing block and the axis of the crankshaft is $r_2$; along an axis direction of the crankshaft, a distance between the first mass center and the second mass center is $l_1$, and a distance between the mass center of the balancing block and the second mass center is $l_2$, and it is satisfied that:

$$0.6 \le \frac{m_2 r_2 l_2}{m_1 r_1 l_1} \le 0.9.$$

10. The compressor according to claim 1, wherein the crankshaft comprises a main shaft body, and the motor rotor is sleeved on a first end of the main shaft body, and the first eccentric portion and the second eccentric portion are disposed at a second end of the main shaft body.

11. An air conditioner, comprising the compressor of claim 1.

12. A compressor, comprising:

a crankshaft, wherein the crankshaft comprises a first eccentric portion and a second eccentric portion, and the first eccentric portion and the second eccentric portion are located on different shaft sections of the crankshaft respectively;

a first roller sleeved on an outer circumference of the first eccentric portion, the interior of the first roller being a solid structure;

a second roller sleeved on an outer circumference of the second eccentric portion, the interior of the second roller having a hollow portion to form a cavity;

a motor rotor sleeved on the crankshaft; and one balancing block disposed at an axial end of the motor rotor;

wherein a mass center of the first eccentric portion and the first roller is a first mass center, and an first mass-center axis passes through the first mass center and is parallel to an axis of the crankshaft; a mass center of the second eccentric portion and the second roller is a second mass center, and a second mass-center axis passes through the second mass center and is parallel to the axis of the crankshaft; and a mass center of the balancing block, the first mass-center axis and the second mass-center axis are located in the same plane; and in the plane, the first mass center is located on a first side of the axis of the crankshaft, and the mass center of the balancing block is located on a second side of the axis of the crankshaft, and the axis of the crankshaft is located between the mass center of the balancing block and the first mass center; and the second mass center is located on the second side of the axis of the crankshaft;

wherein two hollow portions are provided, and the two hollow portions are spaced apart along an axial direction of the second roller; a supporting portion is disposed between the two hollow portions; radial thicknesses of radial inner walls of the two hollow portions each are b1, and radial thicknesses of radial outer walls of the two hollow portions each are a1; an axial thickness of a third axial end of one hollow portion away from the other hollow portion is c1, and an axial thickness of a fourth axial end of the other hollow portion away from the one hollow portion is d1; a total radial thickness of the second roller is t, and a total axial thickness of the second roller is h, and it is satisfied that:

$$a1 \ge \frac{1}{6}t,\ b1 \ge \frac{1}{6}t,\ c1 \ge \frac{1}{12}h, \text{ and } d1 \ge \frac{1}{12}h.$$

13. The compressor according to claim 12, wherein the first roller is located between the motor rotor and the second roller along an axis direction of the crankshaft.

14. The compressor according to claim 13, wherein the balancing block is disposed on the motor rotor and is located at one axial end of the motor rotor away from the first roller along the axis direction of the crankshaft; or the balancing block is arranged on the motor rotor and is located at another axial end of the motor rotor adjacent to the first roller along the axis direction of the crankshaft.

15. The compressor according to claim 12, wherein an axial thickness of the supporting portion is e1, and $$e1 \ge \frac{1}{24}h.$$

16. The compressor according to claim 12, wherein the compressor is a vertical compressor, the first roller and the second roller are arranged vertically; the first roller is located above the second roller; the motor rotor is located above the first roller; and the balancing block is arranged on an upper end surface of the motor rotor or on a lower end surface of the motor rotor.

17. A compressor, comprising:

a crankshaft, wherein the crankshaft comprises a first eccentric portion and a second eccentric portion, and the first eccentric portion and the second eccentric portion are located on different shaft sections of the crankshaft respectively;

a first roller sleeved on an outer circumference of the first eccentric portion, the interior of the first roller being a solid structure;

a second roller sleeved on an outer circumference of the second eccentric portion, the interior of the second roller having a hollow portion to form a cavity;

a motor rotor sleeved on the crankshaft; and one balancing block disposed at an axial end of the motor rotor;

wherein a mass center of the first eccentric portion and the first roller is a first mass center, and an first mass-center axis passes through the first mass center and is parallel to an axis of the crankshaft; a mass center of the second eccentric portion and the second roller is a second mass center, and a second mass-center axis passes through the second mass center and is parallel to the axis of the crankshaft; and a mass center of the balancing block, the first mass-center axis and the second mass-center axis are located in the same plane; and in the plane, the first mass center is located on a first side of the axis of the crankshaft, and the mass center of the balancing block is located on a second side of the axis of the crankshaft, and the axis of the crankshaft is located between the mass center of the balancing block and the first mass center; and the second mass center is located on the second side of the axis of the crankshaft;

wherein the number of the hollow portions is n, and the n hollow portions are spaced and arranged sequentially along an axial direction of the second roller, wherein $n \geq 1$; a total radial thickness of the second roller is t, and a total axial thickness of the second roller is h;

radial thicknesses of radial outer walls of the n hollow portions each are a, and radial thicknesses of radial inner walls of the n hollow portions each are b, and it is satisfied that $a \geq t/(2(n+1))$, and $b \geq t/(2(n+1))$;

among the n hollow portions, an axial thickness of one axial end of each hollow portion is c, and an axial thickness of the other axial end of each hollow portion is d, and it is satisfied that $c \geq h/(4(n+1))$, and $d \geq h/(4(n+1))$; and a supporting portion is arranged between any two adjacent hollow portions among the n hollow portions, and axial thicknesses e of multiple supporting portions are equal, and $e \geq h/(8(n+1))$.

18. The compressor according to claim 17, wherein the first roller is located between the motor rotor and the second roller along an axis direction of the crankshaft.

19. The compressor according to claim 18, wherein the balancing block is disposed on the motor rotor and is located at one axial end of the motor rotor away from the first roller along the axis direction of the crankshaft; or the balancing block is arranged on the motor rotor and is located at another axial end of the motor rotor adjacent to the first roller along the axis direction of the crankshaft.

20. The compressor according to claim 17, wherein the compressor is a vertical compressor, the first roller and the second roller are arranged vertically; the first roller is located above the second roller; the motor rotor is located above the first roller; and the balancing block is arranged on an upper end surface of the motor rotor or on a lower end surface of the motor rotor.

* * * * *